US005737676A

United States Patent [19]

Maeda et al.

[11] Patent Number: 5,737,676

[45] Date of Patent: Apr. 7, 1998

[54] LATENT ELECTROSTATIC IMAGE DEVELOPING DEVICE HAVING REGULATING BLADE WITH CHAMFER

[75] Inventors: Masahiko Maeda; Masayuki Nakashima; Masao Uyama; Shoji Tomita; Kenichiro Kitajima, all of Osaka, Japan

[73] Assignee: Mita Industrial, Osaka, Japan

[21] Appl. No.: 659,749

[22] Filed: Jun. 6, 1996

[30] Foreign Application Priority Data

Jul. 4, 1995 [JP] Japan ..... 7-168685

[51] Int. Cl.[6] ..... G03G 15/08

[52] U.S. Cl. ..... 399/284

[58] Field of Search ..... 399/274, 284

[56] References Cited

U.S. PATENT DOCUMENTS 4,920,916 5/1990 Mizuno et al. .
5,220,129 6/1993 Nishio et al. .
5,338,895 8/1994 Ikegawa et al. .
5,552,867 9/1996 Sekino et al. .

OTHER PUBLICATIONS

Japanese Patent Abstract, Umeno et al., 07-036277, Feb. 1995.

*Primary Examiner*—Robert Beatty
*Attorney, Agent, or Firm*—Beveridge, DeGrandi, Weilacher & Young, L.L.P.

[57] ABSTRACT

A latent electrostatic image developing device for use in developing a latent electrostatic image to a toner image in an image forming machine. The device includes a developing roller within a development housing for holding a developer on its surface in a developer holding zone and conveying the developer, which is held to a developing zone, in order to apply it to a latent electrostatic image. A restricting portion has a blade which includes a rigid part for acting on the surface of the developing roller in a developer restricting zone located between the developer holding zone and the developing zone in order to restrict the amount of the developer held on the surface. The blade is caused to protrude to the upstream side as viewed in the direction of movement of the developing roller, and that border of its protrusion facing the developing roller is provided with a C 0.1 to 0.6 mm chamfer (C being the JIS designation for a 45 degree chamfer).

3 Claims, 4 Drawing Sheets

LATENT ELECTROSTATIC IMAGE DEVELOPING DEVICE HAVING REGULATING BLADE WITH CHAMFER

FIELD OF THE INVENTION

This invention relates to a latent electrostatic image developing device for use in developing a latent electrostatic image to a toner image in an image forming machine such as an electrostatic copying machine or a laser printer. More specifically, it relates to a latent electrostatic image developing device of the type including a developing roller for holding a developer on its surface to convey it to a developing zone, and a restricting means comprising a rigid member which acts on the surface of the developing roller to restrict the amount of the developer held on that surface.

DESCRIPTION OF THE PRIOR ART

As is well known, a latent electrostatic image developing device of the type including a developing roller to be rotationally driven in a predetermined direction is widely used to develop a latent electrostatic image to a toner image in an image forming machine. While being rotationally driven in the predetermined direction, the developing roller is moved to a developer holding zone, a developer amount restricting zone, and a developing zone in this order. In the developer holding zone, a toner as a developer to be fed in a suitable manner is held on the surface of the developing roller. In the developer amount restricting zone, a restricting means acts on the toner as developer held on the surface of the developing roller to restrict the toner held on the surface of the developing roller to a required amount. In the developing zone, the toner as developer is applied to the surface of a latent electrostatic image bearing member, such as a rotating drum having an electrophotographic photosensitive layer on its peripheral surface, to develop a latent electrostatic image formed on the surface of the latent electrostatic image bearing member to a toner image. To perform satisfactory development, it is important that the amount of the toner held on the surface of the developing roller be restricted appropriately by the restricting means so that a toner layer held on the surface of the developing roller be formed to have a predetermined thickness sufficiently uniform in the axial direction.

Japanese Patent Publication No. 16736/1988 discloses a latent electrostatic image developing device including a restricting means having a blade composed of a rubber elastomer comprising synthetic rubber such as urethane rubber or silicone rubber. The rubber elastomer constituting the developer restricting means has its one surface or front edge brought into pressed contact with the surface of the developing roller. The amount of the toner held on the surface of the developing roller is thereby restricted to a considerably small amount to form a thin layer of the toner on the surface of the developing roller. The blade of the developer restricting means, which is constructed of a 0.1 to 0.2 mm thick stainless steel sheet for a spring, is also put to practical use. With the developer restricting means using an elastic blade of a rubber elastomer or a stainless steel sheet, opposite end portions of the elastic blade are low in rigidity and inferior in a restricting force to a central portion thereof. Thus, a toner layer formed on the surface of the developing roller is thicker at the opposite end portions than at the central portion. According to our experiments, the use of a urethane blade was found to give the toner layer at the opposite end portions which was 3.5 to 7.0 μm thicker than at the central portion. Thus, the use of the elastic blade posed the problem of difficulty in giving the toner layer on the surface of the developing roller a uniform thickness in the entire axial direction, accordingly, difficulty in obtaining a uniform image. The elastic blade is also low in wear resistance and not entirely satisfactory in terms of life.

To solve the above problems with the elastic blade, we proposed in Japanese Laid-Open Patent Publication No. 36277/1995 an invention directed at forming the blade for use in the developer restricting means from a rigid member of glass or the like. By forming the blade of a sheet glass, it became possible to restrict the thickness of the toner layer on the surface of the developing roller to be uniform widthwise, and improve the wear resistance of the blade, prolonging its life.

The blade constituting the developer restricting means, which is formed of a rigid member of glass or the like, protrudes to the upstream side when viewed in the direction of movement of the developing roller. The amount of its protrusion was found to determine the thickness of the toner layer formed on the surface of the developing roller. Controlling the amount of the protrusion of the blade to be at a predetermined value, however, is considerably difficult in production. A strict quality control of such a parameter in production would induce a wasteful buildup of the cost.

With the blade for the developer restricting means, which is formed of a sheet glass, if its border undergoing the action of the toner is square-edged, it is liable to become chipped. The chips, if interposed between the developing roller and the blade, would adversely affect the formation of the toner layer.

SUMMARY OF THE INVENTION

The present invention has been achieved in the light of the foregoing facts. Its principal object is to provide a latent electrostatic image developing device capable of easily maintaining the thickness of a toner layers formed on the surface of the developing roller, within a predetermined range by applying a predetermined chamfer to the border of the blade made of a rigid member constituting the developer restricting means.

Another object of the invention is to provide a latent electrostatic image developing device capable of preventing the border of the blade undergoing the action of the toner from being damaged even when the blade for the developer restricting means is composed of a sheet glass.

Still another object of the invention is to provide a developer amount restricting blade constituting the restricting means which is to be applied to the latent electrostatic image developing device.

To attain the aforementioned principal object, the present invention provides a latent electrostatic image developing device comprising a development housing, a developing roller disposed in the development housing for holding a developer on its surface in a developer holding zone, and conveying the developer held to a developing zone to apply it to a latent electrostatic image, and a restricting means having a blade comprising a rigid member for acting on the surface of the developing roller in a developer restricting zone located between the developer holding zone and the developing zone to restrict the amount of the developer held on the surface, wherein the blade comprising the rigid member is caused to protrude to the upstream side as viewed in the direction of movement of the developing roller, and that border of its protrusion facing the developing roller is provided with a C 0.1 to 0.6 mm chamfer.

To attain the other object, the present invention provides a latent electrostatic image developing device comprising a development housing, a developing roller disposed in the development housing for holding a developer on its surface in a developer holding zone, and conveying the developer held to a developing zone to apply it to a latent electrostatic image, and a restricting means having a blade comprising a sheet glass for acting on the surface of the developing roller in a developer restricting zone located between the developer holding zone and the developing zone to restrict the amount of the developer held on the surface, wherein the blade comprising the sheet glass is caused to protrude to the upstream side as viewed in the direction of movement of the developing roller, and that border of its protrusion facing the developing roller is provided with a chamfer.

The present invention, moreover, provides a developer amount restricting blade constituting a restricting means which acts on the surface of a developing roller in a latent electrostatic image developing device to restrict the amount of a developer held on the surface of the developing roller, wherein the blade is composed of a sheet glass, and its border on the upstream side, as viewed in the direction of movement of the developing roller, on the side where it acts on the surface of the developing roller, is provided with a chamfer.

DETAILED DESCRIPTION OF THE PREFERRED EMBODIMENTS

The present invention will now be described by reference to accompanying drawings showing preferred embodiments of a latent electrostatic image developing device constructed in accordance with the present invention, and a developer amount restricting blade for application thereto.

Figure 1:
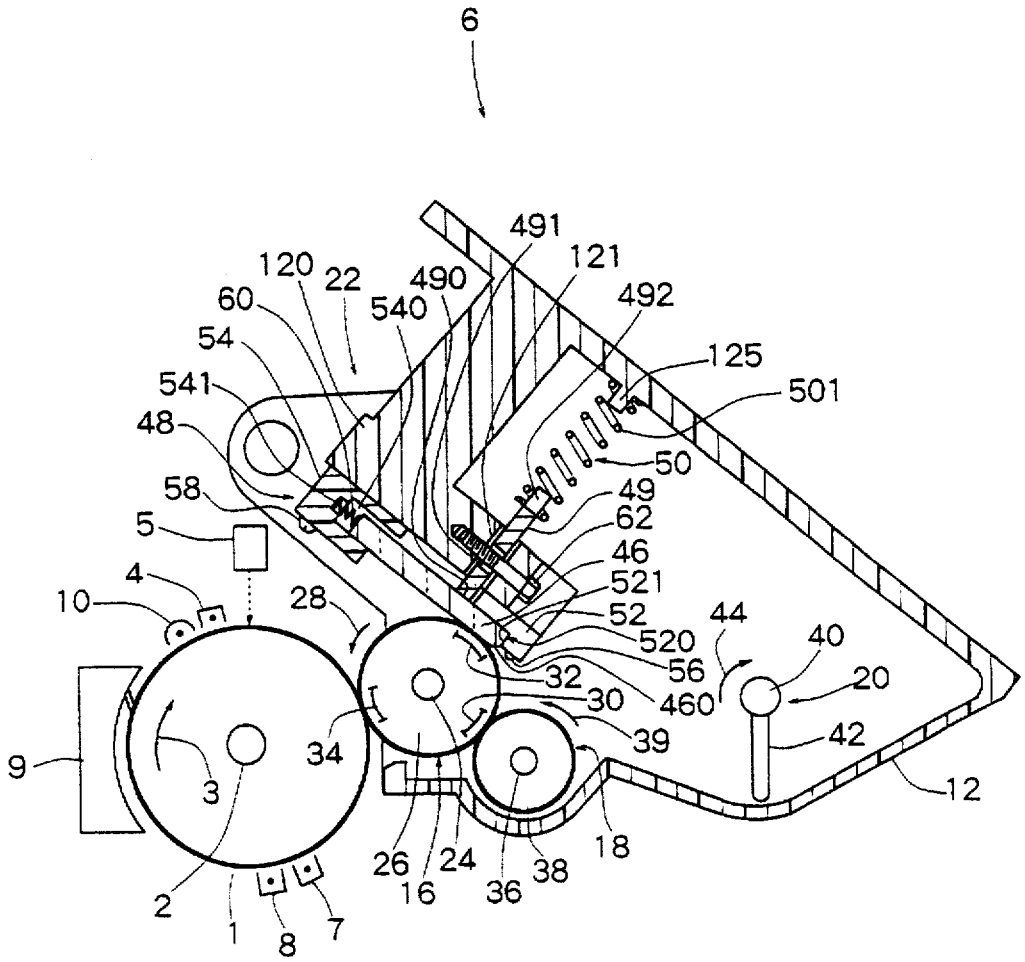
FIG. 1 is a schematic structural sectional view of an image forming machine on which a latent electrostatic image developing device constructed in accordance with the present invention is mounted.

FIG. 1 illustrates an image forming machine on which a latent electrostatic image developing device constructed in accordance with the present invention is mounted. The illustrated image forming machine has a rotating drum 1 as an image bearing member provided with a photosensitive layer on the peripheral surface thereof. The rotating drum 1 is mounted within a machine body housing (not shown) rotatably by a rotating shaft 2. Around the rotating drum 1 to be rotated in the direction of an arrow 3 are disposed sequentially in the direction of its rotation a charging corona discharger 4 for charging the photosensitive layer of the rotating drum 1 to a specific polarity; a laser optical device 5 as an exposure means for forming a latent electrostatic image on the photosensitive layer of the rotating drum 1 charged by the charging corona discharger 4 to the specific polarity; a latent electrostatic image developing device 6 for developing the latent electrostatic images formed by laser light emitted by the optical device 5, to a toner image; a corona discharger 7 for transfer; a corona discharger 8 for peeling; a cleaning device 9; and a destaticizing lamp 10.

The developing device 6 has a development housing 12 which may be formed of a plastic material. In the development housing 12 are disposed a developing roller 16, a feeding means 18, an agitating means 20, and a restricting means 22. Further, a toner cartridge (not shown) accommodating a toner is mounted in the development housing 12.

The developing roller 16 includes a rotating shaft 24 mounted rotatably between the opposite side walls of the development housing 12, and a roller 26 bonded to the rotating shaft 24. The rotating shaft 24 may be formed of a suitable metallic material such as stainless steel. The roller 26 is composed of a relatively flexible and conductive material, e.g., conductive solid rubber such as urethane rubber. The hardness of the roller 26 is set, in the illustrated embodiment, at an Asker hardness of about 60 to 85. The volume resistivity of the roller 26 is set at about $10^6$ to $10^9$ Ωcm. The roller 26 of the developing roller 16 constructed as above is exposed to face the rotating drum 1 through an opening formed in the development housing 12. The peripheral surface of the roller 26 is brought into pressed contact with the peripheral surface of the rotating drum 1. In this pressed contact region, the peripheral surface of the roller 26 is compressed slightly elastically. The rotating shaft 24 of the developing roller 16 is continuously rotationally driven by a driving means (not shown) in a direction shown by an arrow 28 in FIG. 1. Upon this rotation of the rotating shaft 24, the roller 26 is also continuously rotationally driven in the direction shown by the arrow 28. Thus, the peripheral surface of the roller 26 is conveyed through a developer holding zone 30, a developer restricting zone 32, and a developing zone 34 in this order.

The feeding means 18 includes a rotating shaft 36 mounted rotatably between the opposite side walls of the development housing 12, and an auxiliary roller 38 bonded to the rotating shaft 36. The auxiliary roller 38 is composed of a foam such as a silicone foam or a urethane foam. The auxiliary roller 38 is brought into pressed contact with the roller 26 of the developing roller 16. The hardness of the foam constituting the auxiliary roller 38 is considerably small (say, an Asker hardness of about 35) compared with the hardness of the roller 26. By keeping the auxiliary roller 38 in pressed contact with the roller 26, the auxiliary roller 38 is desirably compressed elastically in the pressed contact region at about 0.15 to 0.25 mm. The auxiliary roller 38 is continuously rotationally driven by a driving means (not shown) in a direction shown by an arrow 39 in FIG. 1. The agitating means 20 includes a rotating shaft 40 mounted rotatably between the opposite side walls of the development housing 12, and an agitating member 42 fixed to the rotating shaft 40. The agitating means 20 is continuously rotationally driven by a driving means (not shown) in a direction shown by an arrow 44 in FIG. 1.

Next, the restricting means 22 will be described by reference to FIG. 2 as well. The restricting means 22 comprises a blade 46 made of a rigid member which is brought into pressed contact with the peripheral surface of the roller 26 of the developing roller 16; a blade supporting means 48 for supporting the blade 46 movably so that one surface thereof can be contacted under pressure with the peripheral surface of the roller 26; a pressing member 49 to contact the other surface of the blade 46; and an elastically urging means 50 for pressing the blade 46 via the pressing member 49 in a direction in which the one surface thereof is brought into pressed contact with the peripheral surface of the roller 26.

The blade 46 comprising the rigid member is composed of a plate-like member having at least one surface (the surface to be brought into pressed contact with the peripheral surface of the roller 26) being a flat surface extending widthwise (the direction perpendicular to the sheet surface of FIG. 1) along the peripheral surface of the roller 26. The surface roughness of at least that region in the one surface of the blade 46 which is in pressed contact with the peripheral surface of the roller 26 is sufficiently small; the center line average roughness Ra defined under JIS B 0601 is 6.00 or less, preferably 0.20 or less, and more preferably 0.02 or less. If the surface roughness of the one surface of the blade 46 is too large, the surface of a toner layer formed on the peripheral surface of the roller 26 constituting the developing roller 16 is liable not to be fully flattened, but to be nonuniform. Thus, a commercially available sheet glass can be quoted as a preferred rigid material which can form the blade 46 at a relatively low costs but still has a sufficiently small surface roughness, high hardness, and wear resistance. The thickness of the sheet glass may be about 3 mm. If it is desired to apply a required voltage to the blade 46 for the purpose of controlling the charge characteristics of the toner, a conductive film may be coated on one surface of the sheet glass. As the sheet glass with a conductive film on one surface, a sheet glass marketed under the trade name "NESAGLASS" can be used advantageously. Instead of a sheet glass, the blade 46 may be formed from a rigid member taken from a suitable metal plate such as a stainless steel plate. To make the surface roughness of one surface of the metal plate constituting the blade 46 sufficiently smalls a suitable surface treatment may be applied to the one surface of the metal plate, where necessary. If desired, the blade 46 may be constructed from a laminate of a sheet glass and a metal plate, and one surface thereof to be brought into pressed contact with the roller 26 of the developing roller 16 may be defined by the exposed surface of the sheet glass.

Figure 3A:
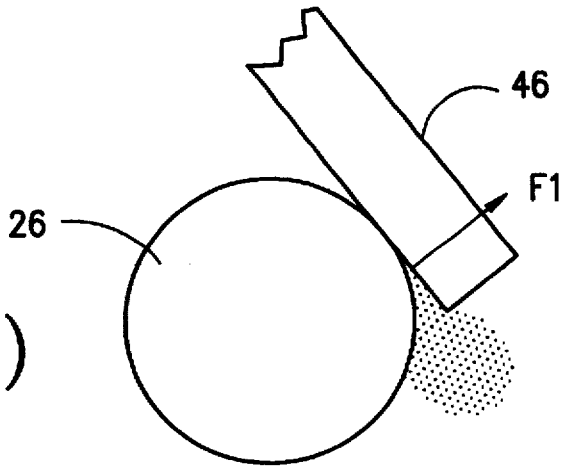
Fig. 3(a) PRIOR ART
FIG. 3*a*–3*c* are explanatory views showing a force acting on a blade constituting the restricting means mounted on the latent electrostatic image developing device shown in FIG. 1.
Figure 3B:
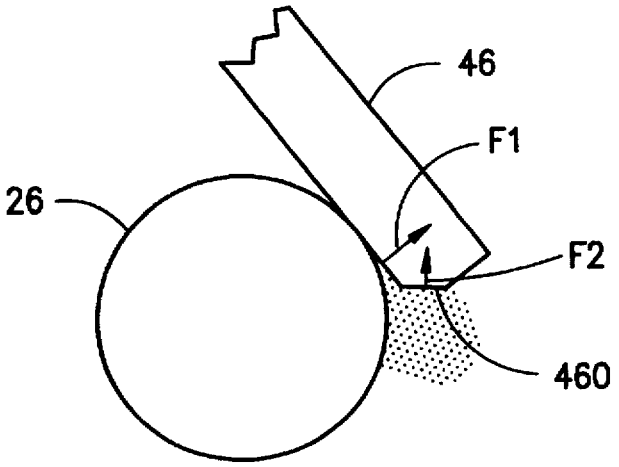
Figure 3C:
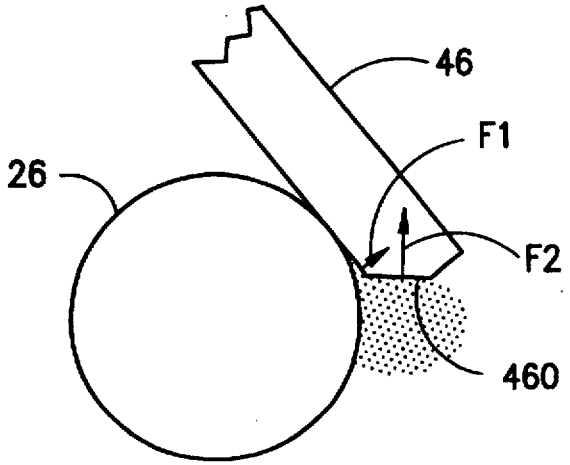
Figure 4:
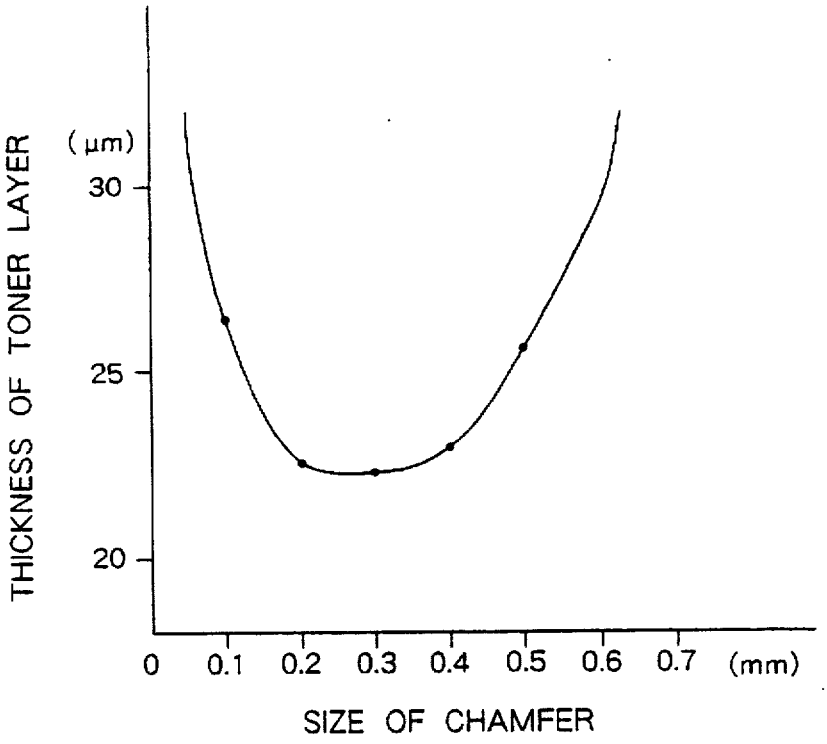
FIG. 4 is a graph showing the relation found experimentally between the size of the chamfer formed in the blade constituting the restricting means and the thickness of the toner layer formed on the surface of the developing roller.

A lower end portion of the blade 46 is caused to protrude somewhat to the upstream side as viewed in the direction of movement of the roller 26, beyond the site of pressed contact between the roller 26 of the developing roller 16 and the blade 46. The length of this protrusion of the lower end portion of the blade 46 (i.e., the length from the center of contact between the roller 26 and the blade 46 to the lower end of the blade 46) is generally 0.5 to 4.0 mm, particularly 0.8 to 3.5 mm, particularly preferably 1.0 to 2.0 mm. If the length of the protrusion is so small as to be substantially zero, the restricting action of the blade 46 is excessive, tending to make the formation of a satisfactory toner layer difficult. If the length of the protrusion is too large, the thickness of the toner layer formed is liable to be excessive, making the amount of charge on the toner too small. That border of the lower end portion of the blade 46 which lies on the roller 26 side is provided with a chamfer 460. An explanation will follow for how to set the chamfer 460 to be formed at the border on the roller 26 side in the lower end portion of the blade 46. FIGS. 3(*a*), 3(*b*) and 3(*c*) show the direction and magnitude of a force that the toner exerts on the blade 46 when there is no chamfer, a small chamfer, and a large chamfer, respectively. In the absence of a chamfer as shown in FIG. 3(*a*), the toner, moving adhering to the surface of the roller 26, acts on one surface of the blade 46, and the force F1 works in a direction in which it causes the blade 46 to escape from the roller 26. This force F1 is so high that it is difficult to restrict the toner layer to a predetermined thickness. In the presence of the small chamfer shown in FIG. 3(*b*), the toner, moving adhering to the surface of the roller 26, acts on one surface of the blade 46 and its chamfer. Thus, the force F1 working in a direction in which it causes the blade 46 to escape from the roller 26, and the force F2 pushing the chamfer are produced. However, F1 is less than in the absence of the chamfer, so that the resultant force acting in a direction in which it causes the blade 46 to escape from the roller 26 is smaller than when there is no chamfer. In the presence of the large chamfer shown in FIG. 3(*c*), the toners moving adhering to the surface of the roller 26, likewise acts on one surface of the blade 46 and its chamfer. In this case, the force F1 working in a direction in which it causes the blade 46 to escape from the roller 26 is decreased, while the force F2 pushing the chamfer is increased. Thus, the resultant force acting in a direction in which it causes the blade 46 to escape from the roller 26 is larger than when the small chamfer is applied. FIG. 4 is a graph showing the relation found experimentally between the size of the chamfer formed in the blade and the thickness of the toner layer formed on the surface of the roller 26. The roller 26 was formed of urethane rubber with an Asker C hardness of 73, and had a diameter of 16 mm and an axial length of 234 mm. The blade 46 was constructed of a sheet glass 230 mm long, 15.5 mm wide and 3 mm thick. The length of protrusion of the lower end portion of the blade 46 (the length from the center of contact between the roller 26 and the blade 46 to the lower end of the blade 46) was 1.25 mm. The force of pressed contact of the blade 46 with the peripheral surface of the roller 26 was 70 g/cm as linear pressure. Under these conditions, experiments were conducted. Incidentally, if the thickness of the toner layer formed on the surface of the roller constituting the developing roller is, say, 20 μm or less, the image density is so low that the resulting copy is hard to see. If the thickness of the toner layer is, say, 30 μm or more, a so-called image base fog occurs in which the toner adheres to a portion other than the image. Hence, the thickness of the toner layer is generally set at 20 to 30 μm. The relation between the size of the chamfer formed in the blade and the thickness of the toner layer formed on the surface of the roller, as shown in FIG. 4, demonstrates that a chamfer measuring C 0.1 to 0.6 mm is sufficient to obtain a toner layer 20 to 30 μm thick C being the JIS designation for a 45 degree chamfer.

The blade supporting means 48 includes a pair of lower supporting members 52, 52 for supporting the opposite lower ends of the blade 46, and an upper supporting member 54 for supporting an upper edge portion of the blade 46. The lower supporting members 52, 52 have cutouts 520, 520 forming bottom surfaces 521, 521 and side surfaces 522, 522, and mounting holes 523, 523 elongated in the up-and-down direction. The lower supporting members 52, 52 are disposed widthwise with a predetermined spacing, and are secured to a mounting portion 120, formed integrally with the development housing 12, by screws 56, 56 passing through the mounting holes 523, 523. The lower supporting members 52, 52 to be secured to the mounting portion 120 are mounted so that the distance between the side surfaces 522 and 522 forming the cutouts 520 and 520 will be nearly the same length as the widthwise dimension of the blade 46, and that the lower end surface of opposite end portions of the blade 46 will be situated on the bottom surfaces 521, 521 forming the cutouts 520, 520. The upper supporting member 54 is disposed above the lower supporting members 52, 52 at a predetermined distance from them, and is secured to the mounting portion 120 of the development housing 12 by means of a plurality of screws 58. The upper supporting member 54 is provided with a fitting groove 540 having nearly the same length as the widthwise dimension of the blade 46 and slightly wider than the wall thickness of the blade 46. An upper edge portion of the blade 46 is fitted into the fitting groove 540. As shown in FIG. 1, a plurality of recesses 541 are formed longitudinally in the bottom surface of the fitting groove 540. Coiled compression springs 60 are disposed in the recesses 541, and act on the upper end surface of the blade 46 fitted into the fitting groove 540, pushing and urging the blade 46 downwards.

The pressing member 49 is composed of a stainless steel plate about 2 mm thick, and has nearly the same length as the blade 46 in correspondence with the widthwise length of the blade 46. The pressing member 49 has two elongate holes 491, 491 for guiding, and according to the illustrated embodiment has two supporting projections 492, 492 at its rear side end surface. The thus constituted pressing member 49 is inserted through a through-hole 121 formed in the mounting portion 120 of the development housing 12. Its front side end surface i.e., a contact surface 490, is contacted with the other surface of the blade 46. With the pressing member 49 being inserted through the through-hole 121 formed in the mounting portion 120 of the development housing 12, guide bolts 62, 62 to be screwed into the mounting portion 120 of the development housing 12 are inserted into the two elongate holes 491, 491 formed in the pressing member 49, whereby the movement of the pressing member 49 is guided.

The elastically urging means 50 comprises a plurality of (two in the illustrated embodiment) coiled compression springs 501, 501 disposed between the rear side end surface of the pressing member 49 and the development housing 12. The respective coiled compression springs 501, 501 have an end portion fitted over the supporting projections 492, 492 formed on the rear side end surface of the pressing member 49, and have the other end portion fitted over supporting projections 125, 125 formed in the development housing 12. Thus, they push the blade 46 via the pressing member 49 in a direction in which its one surface is contacted under pressure with the peripheral surface of the roller 26.

The force of the pressed contact of the blade 46 with the peripheral surface of the roller 26 of the developing roller 16 can be suitably set according to the thickness of the toner layer to be formed on the peripheral surface of the roller 26. With a great force of pressed contact, the thickness of the developer layer to be formed on the peripheral surface of the roller 26 is small. If the force of pressed contact is excessively high, a smooth rotation of the roller 26 is likely to be impeded. In the manner of development according to the illustrated embodiment, the thickness of the toner layer to be formed on the peripheral surface of the roller 26 is normally about 20 to 30 μm. To form such a thickness of the developer layer properly, it is recommendable to contact the blade 46 with the peripheral surface of the roller 26 at a linear pressure (a pressure per unit length in the width direction) of 30 to 90 g/cm.

Figure 2:
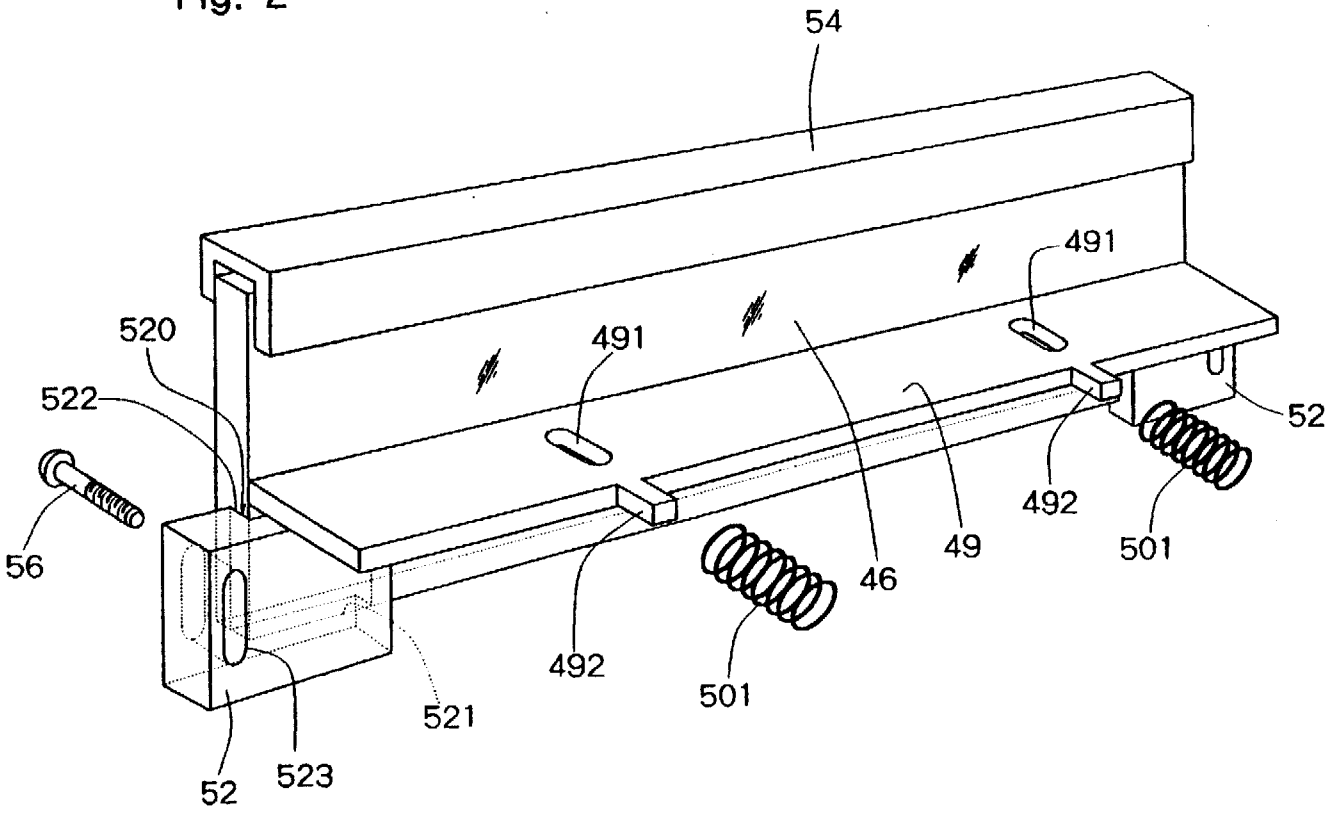
FIG. 2 is a perspective view of a restricting means constituting the latent electrostatic image developing device shown in FIG. 1.

The latent electrostatic image developing device according to the embodiment illustrated in FIG. 1 and FIG. 2 is constructed in the above manner. Its actions will be described below. By starting the operation of the latent electrostatic image developing device, the roller 26 of the developing roller 16, the auxiliary roller 38 of the feeding means 18, and the agitating means 20 are each rotationally driven in the direction of the arrow by the driving means (not shown). The roller 26 of the developing roller 16 is continuously rotationally driven in the direction of arrow 28. In the developer holding zone 30, the feeding means 18 acts on the roller 26, stripping the toner, held on the peripheral surface of the roller 26, from the roller 26, and also feeding a toner anew onto the peripheral surface of the roller 26. In the developer restricting zone 32, the blade 46 of the restricting means 22 acts on the developer held on the peripheral surface of the roller 26, restricting the toner held on the peripheral surface of the roller 26 to a required amount to form a thin layer of the toner. Under the developer restricting action of the blade 46, a toner layer 20 to 30 μm thick is stably formed, since a chamfer measuring C 0.1 to 0.6 mm is provided at that border of the lower end portion of the blade 46 which faces the roller 26. If the blade 46 is formed of a sheet glass having a square-edged border where the toner acts, it is liable to become chipped. The chips, if interposed between the roller 26 and the blade 46, would adversely affect the formation of the toner layer. However, a chamfer is applied to the border, on the roller 26 side, of the lower end portion of the blade 46 where the toner works most, so that the border will not be chipped, but the above possible trouble could be prevented. Under the developer restricting action of the blade 46, moreover, the blade 46 is not bonded, but supported by the lower supporting members 52, 52 and upper supporting member 54 constituting the blade supporting means 48 so as to be movable in a direction in which it is contacted under pressure with the peripheral surface of the roller 26 of the developing roller 16. Since the surface accuracy of the blade 46 is not affected by the surface accuracy of the supporting members, there is no need to process the supporting members with a higher accuracy than required. Furthermore, the spring force of the coiled compression springs 501, 501 constituting the elastically urging means 50 acts on the blade 46 via the pressing member 49. Thus, the blade 46 is not influenced by individual variations in the coiled springs, but undergoes a uniform pressing force throughout its width. Hence, the toner layer formed on the surface of the roller 26 of the developing roller 16 can be made uniform. Then, in the developing zone 34, the developer is applied to the latent electrostatic image on the electrostatic photosensitive material disposed on the peripheral surface of the rotating drum 1 to develop it to a toner image. For example, the latent electrostatic image has a non-image region charged to about +700 V, and an image region charged to about +120 V, the image region being one where the toner adheres (so-called reversal development). The rotating drum 1 is continuously rotationally driven in the direction of arrow 3 in FIG. 1, so that in the developing zone 34, the peripheral surface of the rotating drum 1 and the peripheral surface of the roller 26 of the developing roller 16 are moved in the same direction. The moving speed V2 of the peripheral surface of the roller 26 is set to be somewhat greater than the moving speed V1 of the peripheral surface of the rotating drum 1, and it is preferred that they be in the relationship $1.2V1 \leqq V2 \leqq 2.2V1$. In this case, a sufficient amount of toner is conveyed by the roller 26 to the developing zone 34, and the toner once adhered to the non-image region of the latent electrostatic image is appropriately stripped by the rubbing action of the peripheral surface of the roller 26 against the peripheral surface of the rotating drum 1. Thus, a satisfactory toner image with a proper image density and free from a fog can be obtained. A preferred developer is one consisting of a toner having a volume average particle diameter (vol. 50%: toner with a volume average particle diameter or less, and toner with a volume average particle diameter or more are identical in volume) of about 8.0 to 12.0 μm and a volume resistivity of $10^8$ Ωcm or more.

According to the latent electrostatic image developing device of the present invention, the blade comprising a rigid member for acting on the surface of the developing roller to restrict the amount of the developer held on the surface is caused to protrude to the upstream side as viewed in the direction of movement of the developing roller. The border of its protrusion on the developing roller side is provided with a C 0.1 to 0.6 mm chamfer. Thus, the toner layer in a predetermined range can be formed stably.

According to another aspect of the invention, the blade comprising a sheet glass is caused to protrude to the upstream side as viewed in the direction of movement of the developing roller, and the border of its protrusion on the developing roller side is provided with a chamfer. Since the border of the blade where the toner works most is so chamfered, the border of the blade, if made of a glass plate, will not be chipped. The possible trouble due to the chips can be prevented.

What we claim is:

1. A latent electrostatic image developing device comprising a development housing;

a developing roller disposed in said development housing for holding a developer on a surface of said developing roller in a developer holding zone, conveying said developer held to a developing zone, and applying said developer to a latent electrostatic image; and a restricting means having a blade comprising a rigid member for acting on said surface of said developing roller in a developer restricting zone located between said developer holding zone and said developing zone to restrict an amount of developer held on said surface of said developing roller;

wherein said rigid member extends to the upstream side of said developing roller as viewed in the direction of movement of said developing roller, and has a side that faces said developing roller, said side being provided with a C 0.1 to 0.6 mm chamfer.

2. A latent electrostatic image developing device comprising a development housing;

a developing roller disposed in said development housing for holding a developer on a surface of said developing roller in a developer holding zone, conveying said developer held to a developing zone, and applying said developer to a latent electrostatic image; and a restricting means having a blade comprising sheet glass for acting on said surface of said developing roller in a developer restricting zone located between said developer holding zone and said developing zone to restrict an amount of said developer held on said surface of said developing roller;

wherein said blade extends to the upstream side of said developing roller as viewed in the direction of movement of said developing roller, and has a side that faces said developing roller, said side being provided with a chamfer;

wherein said chamfer measures C 0.1 to 0.6 mm.

3. A developer amount restricting blade for acting on the surface of a developing roller in a latent electrostatic image developing device to restrict the amount of a developer held on the surface of the developing roller, said blade having a portion that is proximate the upstream side of the developing roller, as viewed in the direction of movement of the developing roller, said portion of said blade having a chamfer located on a side of said blade where said developer acts on the surface of said developing roller;

wherein said chamfer measures C 0.1 to 0.6 mm.

* * * * *